US010132215B2

(12) United States Patent
Nagai et al.

(10) Patent No.: US 10,132,215 B2
(45) Date of Patent: Nov. 20, 2018

(54) ENGINE LUBRICATING DEVICE

(71) Applicant: KUBOTA Corporation, Osaka-shi, Osaka (JP)

(72) Inventors: Kentaro Nagai, Sakai (JP); Hideyuki Goto, Sakai (JP); Takahiro Yamazaki, Sakai (JP); Hiroki Oso, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 464 days.

(21) Appl. No.: 14/959,174

(22) Filed: Dec. 4, 2015

(65) Prior Publication Data

US 2016/0281555 A1 Sep. 29, 2016

(30) Foreign Application Priority Data

Mar. 27, 2015 (JP) ..... 2015-067036

(51) Int. Cl.
*F01M 11/03* (2006.01)
*F01M 1/10* (2006.01)
(Continued)

(52) U.S. Cl.
CPC ..... *F01M 1/10* (2013.01); *F01M 11/0004* (2013.01); *F01M 2001/0292* (2013.01);
(Continued)

(58) Field of Classification Search
CPC ..... F01M 2011/007; F01M 2001/1007; F01M 2001/1057; F01M 11/03; B01D 29/114; B01D 35/02; B01D 46/0012
(Continued)

(56) References Cited

U.S. PATENT DOCUMENTS 6,142,257 A 11/2000 Bruener et al.

FOREIGN PATENT DOCUMENTS

JP 2000018017 A 1/2000
JP 2001232118 A 8/2001
(Continued)

OTHER PUBLICATIONS

Extended Search Report dated Aug. 8, 2016 in EP Application No. 15196818.7.

(Continued)

*Primary Examiner* — Marguerite McMahon
*Assistant Examiner* — James Kim
(74) *Attorney, Agent, or Firm* — Panitch Schwarze Belisario & Nadel LLP

(57) ABSTRACT

There is provided an engine lubricating device with which passage resistance of an oil strainer can be reduced and a support stay for an oil filter is unnecessary. An oil strainer includes an outer cylinder and an inner cylinder, the outer cylinder and the inner cylinder respectively have straight central axes and form inner and outer double cylinders, the outer cylinder has a strainer inlet at a lower end, the inner cylinder has a peripheral wall formed as a filter portion, the oil strainer is led out in an orientation inclined downward from the cylinder block toward an inner bottom portion of an oil pan, an upper end portion of the outer cylinder is fixed to a cylinder block, and an upper end opening portion of the inner cylinder communicates with an oil passage inlet of the cylinder block.

17 Claims, 4 Drawing Sheets

(51) Int. Cl.
*F01M 11/00* (2006.01)
*F01M 1/02* (2006.01)

(52) U.S. Cl.
CPC ..... *F01M 2001/1078* (2013.01); *F01M 2011/005* (2013.01); *F01M 2011/007* (2013.01)

(58) Field of Classification Search
USPC ..... 123/195 C, 196 A, 196 R; 210/336
See application file for complete search history.

(56) References Cited

FOREIGN PATENT DOCUMENTS

| | | | | |
|---|---|---|---|---|
| JP | 2005226533 | A | | 8/2005 |
| JP | 2006207401 | A | | 8/2006 |
| JP | 2008008273 | A | * | 1/2008 |
| JP | 2010065546 | A | * | 3/2010 |
| JP | 2010168921 | A | | 8/2010 |
| WO | 2010039138 | A1 | | 4/2010 |

OTHER PUBLICATIONS

Office Action dated Jun. 20, 2017 in EP Application No. 15196818.7.
Office Action dated Mar. 20, 2018 in JP 2015-067036.

* cited by examiner 2
5
5c
6c
B
5
2
6c
5c
2
5
6
5k
5d
6d
6b
5b
5h
5c
5i
5j
7
1a
1
16
6e
17
6f
6g
5m

ENGINE LUBRICATING DEVICE

BACKGROUND OF THE INVENTION (1) Field of the Invention

The present invention relates to an engine lubricating device.

(2) Description of Related Art

Conventionally, as an engine lubricating device, there is a device in which an oil outlet pipe is in a vertical orientation, an intermediate pipe is in a horizontal backward orientation, an oil inlet pipe is in a horizontal sideways orientation, and a cup-shaped oil filter is attached to the oil inlet pipe.

<<Problem 1>> Passage Resistance of the Oil Strainer is High.

In the conventional device, the passage resistance of the oil strainer is large. As a result, a horsepower loss due to the oil strainer is large.

<<Problem 2>> the Support Stay for the Oil Filter is Necessary.

In the conventional device, the support stay for the oil filter is necessary.

SUMMARY OF THE INVENTION

An object of the present invention is to provide an engine lubricating device with which passage resistance of an oil strainer can be reduced and a support stay for an oil filter is unnecessary.

Matters specifying the present invention are as follows.

An engine lubricating device includes a cylinder block, an oil strainer and an oil pan and the oil strainer and the oil pan are mounted to a lower portion of the cylinder block. A strainer inlet of the oil strainer is open at a central portion of an inner bottom of the oil pan.

The oil strainer includes an outer cylinder and an inner cylinder, the outer cylinder and the inner cylinder respectively have straight central axes and form inner and outer double cylinders, and the outer cylinder has the strainer inlet at a lower end, the inner cylinder has a peripheral wall formed as a filter portion.

The oil strainer is led out in an orientation inclined downward from the cylinder block toward the inner bottom portion of the oil pan, an upper end portion of the outer cylinder is fixed to the cylinder block, and an upper end opening portion of the inner cylinder communicates with an oil passage inlet of the cylinder block.

The present invention exerts the following effects.

<<Effect 1>> Passage Resistance of the Oil Strainer can be Reduced.

It is possible to minimize a length of the oil strainer to thereby reduce the passage resistance of the oil strainer. As a result, it is possible to reduce a horsepower loss due to the passage resistance of the oil strainer.

<<Effect 2>> a Support Stay for the Oil Filter is Unnecessary.

Weight of a tip end of the oil strainer (2) is not increased by the oil filter and the support stay for the oil filter is unnecessary.

<<Effect 3>> Inclination Performance of an Engine is High.

Even if an opening area of the strainer inlet is small, it is possible to secure a large enough necessary filtration area at the filter portion. Even when an oil level of the engine oil in the oil pan is low, it is unlikely that the strainer inlet is exposed above an oil surface to take in the air when the engine is inclined, which results in high inclination performance of the engine.

BRIEF DESCRIPTION OF THE DRAWINGS

FIGS. 1A and 1B are drawings for explaining an oil strainer for an engine according to an embodiment of the present invention, wherein FIG. 1A is a vertical sectional side view of the oil strainer and a portion around the oil strainer and FIG. 1B is a sectional view taken along line B-B in FIG. 1A;

FIGS. 2A to 2E are drawings for explaining the oil strainer used in the engine in FIG. 1, wherein FIG. 2A is a drawing in a direction of arrow HA in FIG. 1A, FIG. 2B is a drawing in a direction of arrows B in FIG. 1A, FIG. 2C is a sectional view taken along line IIC-IIC in FIG. 1A, FIG. 2D is a drawing of a first variation of a seal structure of the oil strainer and corresponding to FIG. 2C, and FIG. 2E is a drawing of a second variation of the seal structure of the oil strainer and corresponding to FIG. 2C;

DETAILED DESCRIPTION OF PREFERRED EMBODIMENT

FIGS. 1A to 4 are drawings for explaining an engine lubricating device according to an embodiment of the present invention. In the embodiment, a vertical straight two-cylinder diesel engine will be described.

A general outline of the engine is as follows.

Figure 4:
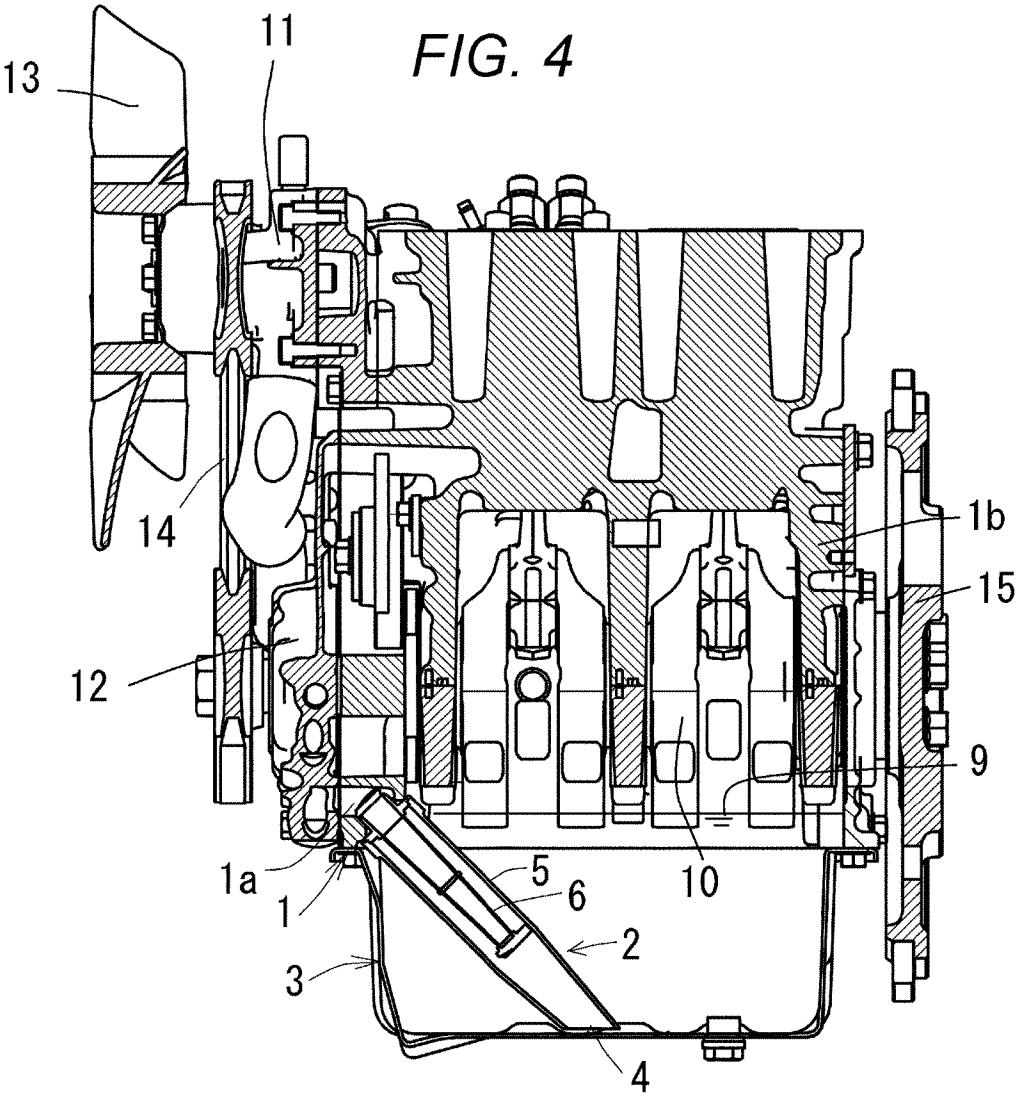
FIG. 4 is a sectional view taken along line IV-IV in FIG. 3.

As shown in FIG. 4, a cylinder head (not shown) is mounted to an upper portion of a cylinder block (1) and a cylinder head cover (not shown) is mounted to an upper portion of the cylinder head. In a crankcase (1*b*) of the cylinder block (1), a crankshaft (10) is supported. A water pump (11) and an oil pump (12) are mounted to a front portion of the cylinder block (1), an engine cooling fan (13) is disposed in front of the water pump (11), the water pump (11) and the engine cooling fan (13) are driven by the crankshaft (10) via a fan belt (14), and the oil pump (12) is also driven by the crankshaft (10).

The cylinder block (1) has an oil passage inlet (1*a*) communicating with the oil pump (12).

An oil pan (3) is mounted to a lower portion of the cylinder block (1) and engine oil (9) is stored in the oil pan (3).

A flywheel (15) is disposed behind the cylinder block (1).

A structure of a lubricating device for this engine is as follows.

Figure 1B:
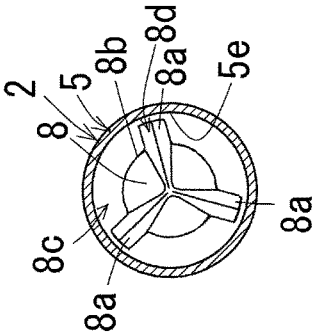
Figure 1A:
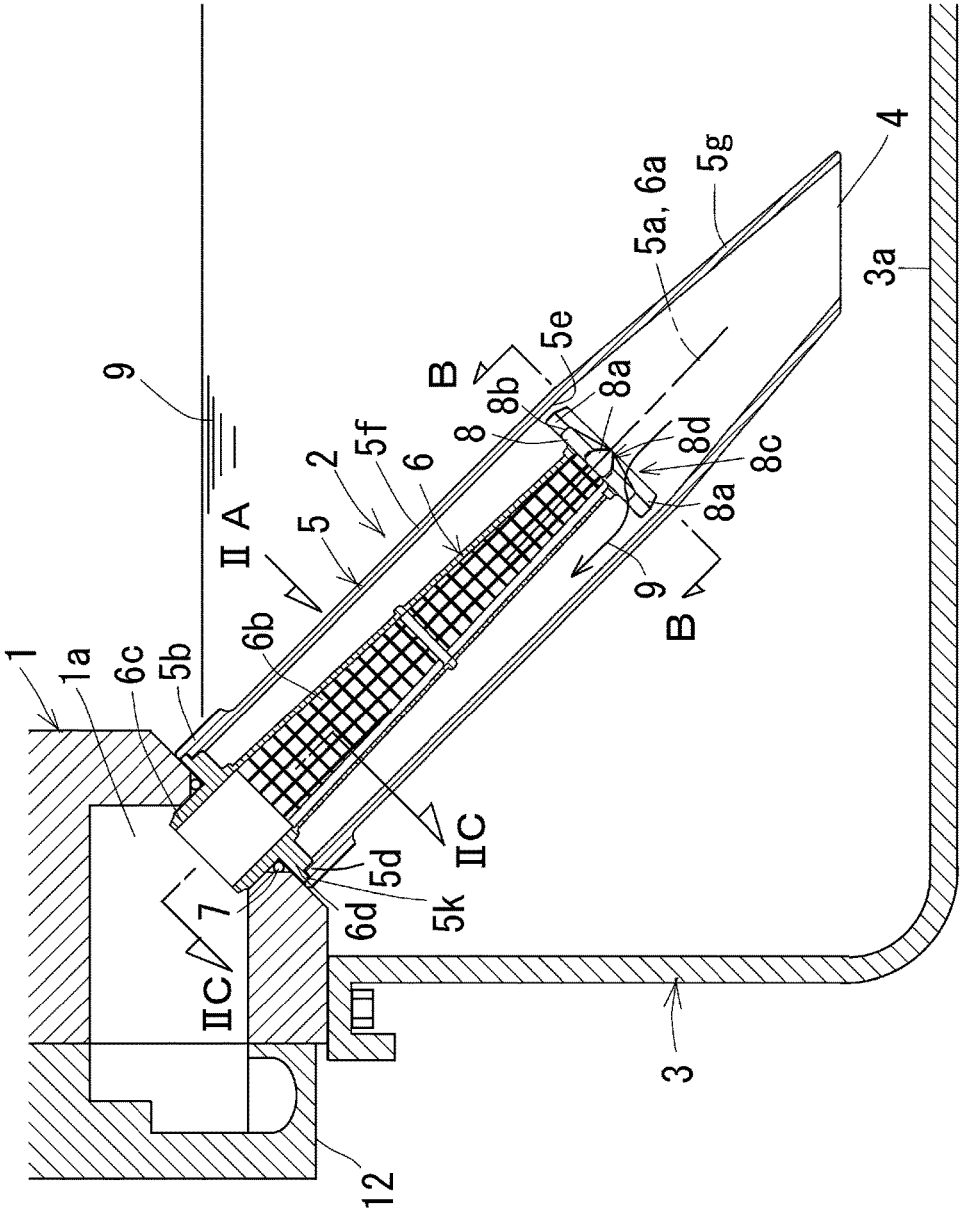

As shown in FIG. 1A, the engine lubricating device includes the cylinder block (1), an oil strainer (2), and the oil pan (3). The oil strainer (2) and the oil pan (3) are mounted to the lower portion of the cylinder block (1). As shown in FIGS. 1A and 4, a strainer inlet (4) of the oil strainer (2) is open at an inner bottom portion of the oil pan (3). Therefore, height of the oil strainer (2) can be small.

Moreover, because the strainer inlet (4) of the oil strainer (2) is open at a central portion of the inner bottom of the oil pan (3), the strainer inlet (4) is less likely to take in air when the engine is inclined.

As shown in FIG. 1A, the oil strainer (2) includes an outer cylinder (5) and an inner cylinder (6), the outer cylinder (5) and the inner cylinder (6) respectively have straight central axes (5*a*), (6*a*) and form inner and outer double cylinders, the outer cylinder (5) has a strainer inlet (4) at its lower end, and the inner cylinder (6) has a peripheral wall formed as a filter portion (6*b*).

As shown in FIG. 1(A), the oil strainer (2) is led out in an orientation inclined downward from the cylinder block (1) toward the inner bottom of the oil pan (3), an upper end portion (5*b*) of the outer cylinder (5) is fixed to the cylinder block (1), and an upper end opening portion (6*c*) of the inner cylinder (6) communicates with the oil passage inlet (1*a*) of the cylinder block (1).

With the above-described structure, it is possible to minimize the length of the oil strainer (2) to thereby reduce passage resistance of the oil strainer (2). As a result, it is possible to reduce a horsepower loss due to the passage resistance of the oil strainer (2).

Moreover, because weight of a tip end of the oil strainer (2) is not increased by the oil filter, a support stay for the oil filter is unnecessary.

Furthermore, even though an opening area of the strainer inlet (4) is small, it is possible to secure a large enough necessary filtration area at the filter portion (6*b*). Even when an oil level of the engine oil (9) in the oil pan (3) is low, it is unlikely that the strainer inlet (4) is exposed above an oil surface to take in the air when the engine is inclined, which results in high inclination performance of the engine.

The outer cylinder (5) is made of synthetic resin and includes a circular cylindrical portion (5*f*) and a tapered portion (5*g*) as shown in FIG. 1A. A seal flange receiving portion (5*d*) is provided to the upper end portion (5*b*) of the circular cylindrical portion (5*f*). A diameter of the tapered portion (5*g*) reduces toward the oil strainer inlet (4) and an opening plane of the oil strainer inlet (4) extends along an inner bottom face (3*a*) of the oil pan (3).

The inner cylinder (6) is also made of synthetic resin and the filter portion (6*b*) is formed by meshes of the peripheral wall of the inner cylinder (6) as shown in FIG. 1A.

Figures 2A, 2B, 2C, 2D, 2E:
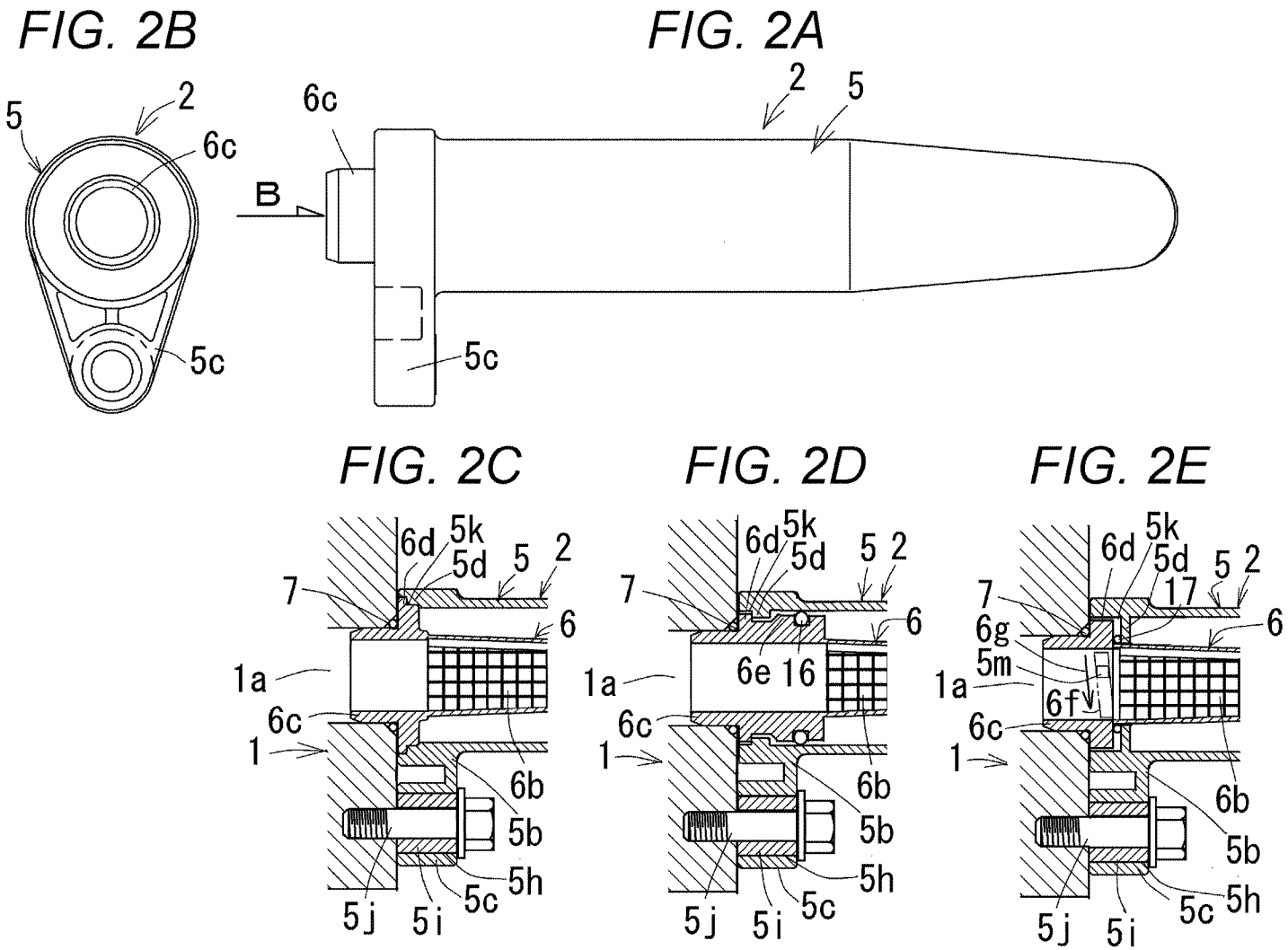
Figure 3:
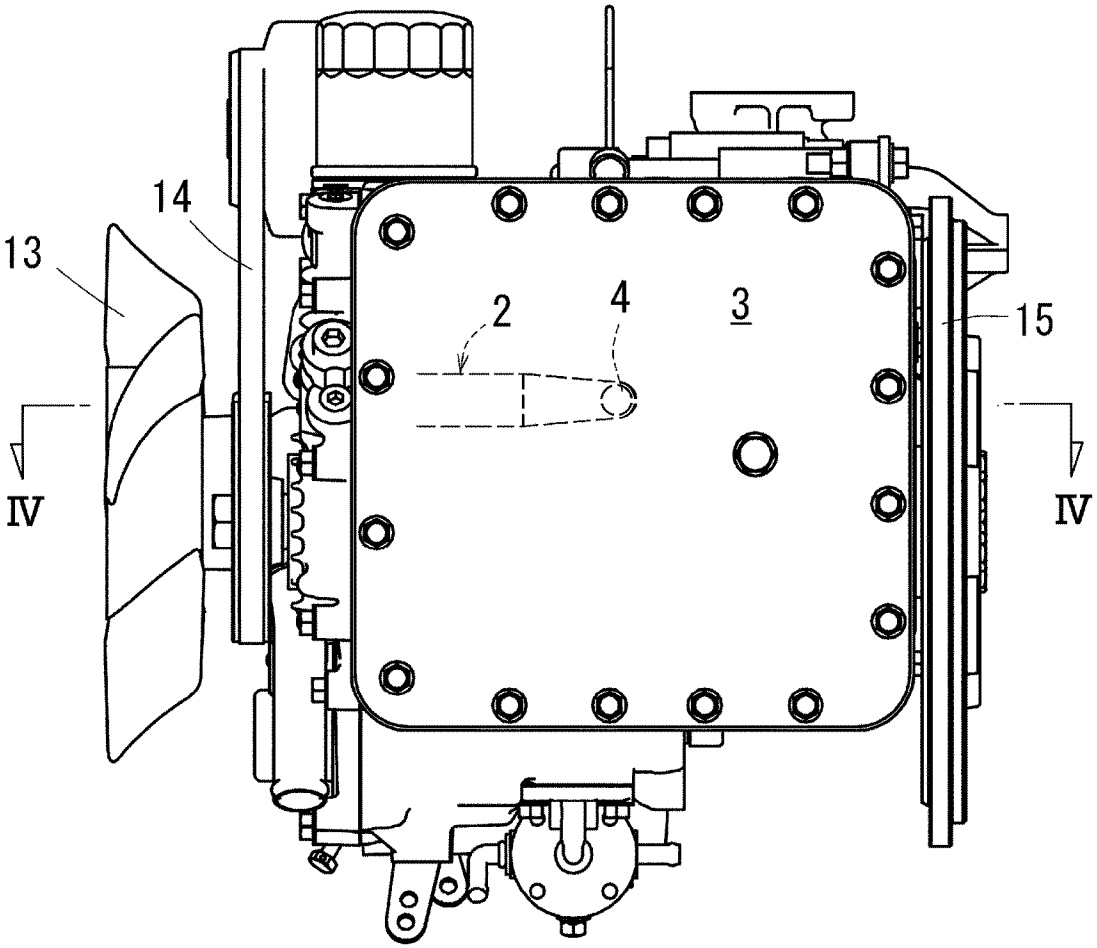
FIG. 3 is a bottom view of the engine according to the embodiment of the invention.

As shown in FIG. 2C, the outer cylinder (5) includes an outer cylinder mounting portion (5*c*) and the seal flange receiving portion (5*d*) and the inner cylinder (6) includes a seal flange (6*d*).

By fixing the outer cylinder mounting portion (5*c*) to the cylinder block (1), the seal flange (6*d*) of the inner cylinder (6) is held and pressed between the seal flange receiving portion (5*d*) of the outer cylinder (5) and the cylinder block (1) and a seal ring (7) is held and pressed between the seal flange (6*d*) of the inner cylinder (6) and the cylinder block (1).

In this way, it is possible to easily seal two positions of the outer cylinder and the inner cylinder (6) of the oil strainer (2).

FIG. 2C shows a basic example of a seal structure of the oil strainer (2).

In this basic example, the outer cylinder mounting portion (5*c*) is led outward from the upper end portion (5*b*) of the outer cylinder (5) and includes a bolt insertion hole (5*h*), a bushing (5*i*), and a mounting bolt (5*j*) and the mounting bolt (5*j*) passes through the bushing (5*i*) fitted in the bolt insertion hole (5*h*) and is fastened to the cylinder block (1) so that the oil strainer (2) is fixed to the cylinder block (1).

The seal flange receiving portion (5*d*) has a seal flange receiving groove (5*k*) and the seal flange receiving groove (5*k*) is formed on an inner periphery of the seal flange receiving portion (3*d*). The seal flange (6*d*) of the inner cylinder (6) is fitted in and comes in contact with the seal flange receiving groove (5*k*).

The seal ring (7) is an O-ring.

FIG. 2(D) shows a first variation of the seal structure of the oil strainer (2).

In the first variation, the inner cylinder (6) has an increased diameter portion (6*e*) and the increased diameter portion (6*e*) is provided on a lower side of a seal flange (6*d*) and press-fitted into an outer cylinder (5), climbs over a seal flange receiving portion (5*d*), and is fitted in the outer cylinder (5). A seal ring (16) is held and pressed between the increased diameter portion (6*e*) and the outer cylinder (5). The seal ring (16) is an O-ring.

Other structures are similar to those in the basic example of the seal structure shown in FIG. 2(C). In FIG. 2(D), the same components as those in the basic example are provided with the same reference signs as in FIG. 2(C).

FIG. 2E shows a second variation of the seal structure of the oil strainer (2).

The second variation includes a lock groove (6*f*) and a lock protrusion (5*m*), the lock groove (6*f*) is formed in a spiral shape in an outer periphery of a seal flange (6*d*), the lock protrusion (5*m*) protrudes from an inner periphery of a seal flange receiving groove (5*k*), the lock protrusion (5*m*) is locked in the lock groove (6*f*), and the seal flange (6*d*) is pressed against a seal flange receiving portion (5*d*) when the lock groove (6*f*) is slid along the lock protrusion by rotating the seal flange (6*d*) in a direction of arrow (6*g*). A seal ring (17) is held and pressed between the seal flange (6*d*) and the seal flange receiving portion (5*d*). The seal ring (17) is an O-ring.

Other structures are similar to those in the basic example of the seal structure shown in FIG. 2(C). In FIG. 2(E), the same components as those in the basic example are provided with the same reference sings as in FIG. 2(C).

As shown in FIGS. 2C to 2E, the outer cylinder mounting portion (5*c*) and the seal flange receiving portion (5*d*) are integrally molded with the outer cylinder (5) and the seal flange (6*d*) is integrally molded with the inner cylinder (6).

Therefore, it is possible to form the oil strainer (2) by using the outer cylinder (5) and the inner cylinder (6) to thereby reduce the number of parts.

As shown in FIGS. 1A and 1B, the inner cylinder (6) has a closing plate (8) and a plurality of shaking preventing protrusions (8*a*), the closing plate (8) closes a lower end of the inner cylinder (6), the respective shaking preventing protrusions (8*a*) protrude radially from an outer peripheral edge (8*b*) of the closing plate (8) toward an inner peripheral face (5*e*) of the outer cylinder (5), and oil passage ports (5*c*) positioned between the adjacent shaking preventing protrusions (8*a*), (8*a*) are provided between the outer peripheral edge (8*b*) of the closing plate (8) and the inner peripheral face (5*e*) of the outer cylinder (5), so that the engine oil (9) is introduced through the oil passage port (8*c*) into an area around the filter portion (6*b*) of the inner cylinder (6).

Therefore, shakes of the inner cylinder (6) due to vibrations of the engine are received by the inner peripheral face (5*e*) of the outer cylinder (5) via the respective shake preventing protrusions (8*a*), which prevents damage to the inner cylinder (6) due to the shakes.

Moreover, shocks of the reception peel oil sludge and the like caught in the filter portion (6*b*), which facilitates regeneration of the filter portion (6*b*).

As shown in FIGS. 1A and 1B, inlets (8*d*) of the oil passage ports (8*c*) have opening sectional areas gradually reducing toward the area around the filter portion (6*b*) of the inner cylinder (6).

Therefore, the engine oil (9) flowing at a velocity increased at the inlets (8*d*) of the oil passage ports (8*c*) flows into the area around the filter portion (6*b*) and a collision of the engine oil (9) peels the oil sludge and the like caught in the filter portion (6*b*), which facilitates regeneration of the filter portion (6*b*).

As shown in FIG. 19, the three shake preventing protrusions (8*a*) in total are provided to extend in radial directions from a central axis (6*a*) of the inner cylinder (6) at every 120° in a circumferential direction of the closing plate (8). As shown in FIG. 1A, a sectional shape of the shake preventing protrusion (8*a*) is a pentagonal base plate shape having a lower vertex portion on a side of the strainer inlet (4). Therefore, an opening sectional area of the inlet (8*d*) of the oil passage port (8*c*) gradually reduces toward the area around the filter portion (6*b*) of the inner cylinder (6).

As shown in FIG. 1A, the filter portion (6*b*) of the inner cylinder (6) is in a tapered shape with its outer diameter increasing from the closing plate (5) at a lower end toward the upper end opening portion (6*c*).

Therefore, the engine oil (9) flowing from the oil passage ports (8*c*) into the area around the filter portion (6*b*) of the inner cylinder (6) peels the oil sludge caught in the filter portion (6*b*) in the tapered shape, which facilitates regeneration of the filter portion (6*b*).

As shown in FIGS. 1A and 1B, the closing plate (8) and the shake preventing protrusions (8*a*) are integrally molded with the inner cylinder (6).

In this way, it is possible to reduce the number of parts.

What is claimed is:

1. An engine lubricating device comprising a cylinder block, an oil strainer, and an oil pan, the oil strainer and the oil pan mounted to a lower portion of the cylinder block and a strainer inlet of the oil strainer being open at a central portion of an inner bottom of the oil pan, wherein the oil strainer includes an outer cylinder and an inner cylinder, the outer cylinder and the inner cylinder form straight inner and outer double cylinders, the outer cylinder has the strainer inlet at a lower end, the inner cylinder has a peripheral wall formed as a filter portion, the oil strainer is led out in an orientation inclined downward from the cylinder block toward the inner bottom portion of the oil pan, an upper end portion of the outer cylinder is fixed to the cylinder block, and an upper end opening portion of the inner cylinder communicates with an oil passage inlet of the cylinder block, and wherein the inner cylinder has a closing plate and a plurality of shake preventing protrusions, the closing plate closes an entire area of a lower end of the inner cylinder and protrudes from the lower end of the inner cylinder toward an inner peripheral face of the outer cylinder, the respective shake preventing protrusions protrude radially from an outer peripheral edge of the closing plate toward the inner peripheral face of the outer cylinder, and oil passage ports positioned between the shake preventing protrusions adjacent in a circumferential direction of the outer peripheral edge of the closing plate are provided between the outer peripheral edge of the closing plate and the inner peripheral face of the outer cylinder so that engine oil is introduced into an area around the filter portion of the inner cylinder through the oil passage ports narrowed with the closing plate and the shake preventing protrusions, without being introduced from the lower end of the inner cylinder into the inner cylinder.

2. The engine lubricating device according to claim 1, wherein the outer cylinder has an outer mounting portion and a seal flange receiving portion, the inner cylinder has a seal flange, the seal flange of the inner cylinder is held and pressed between the seal flange receiving portion of the outer cylinder and the cylinder block and a seal ring is held and pressed between the seal flange of the inner cylinder and the cylinder block by fixing the outer cylinder mounting portion to the cylinder block.

3. The engine lubricating device according to claim 2, wherein the outer cylinder mounting portion and the seal flange receiving portion are integrally molded with the outer cylinder and the seal flange is integrally molded with the inner cylinder.

4. The engine lubricating device according to claim 1, wherein inlets of the oil passage ports have opening sectional areas gradually reducing toward the area around the filter portion of the inner cylinder, and a sectional shape of the shake preventing protrusion has a lower vertex portion facing to a side of the strainer inlet along a direction of central axes of the outer cylinder and the inner cylinder.

5. The engine lubricating device according to claim 1, wherein the filter portion of the inner cylinder is in a tapered shape having a diameter increasing from the closing plate at a lower end toward the upper end opening portion.

6. The engine lubricating device according to claim 1, wherein the closing plate and the shake preventing protrusions are integrally molded with the inner cylinder.

7. The engine lubricating device according to claim 2, wherein inlets of the oil passage ports have opening sectional areas gradually reducing toward the area around the filler portion of the inner cylinder.

8. The engine lubricating device according to claim 3, wherein inlets of the oil passage ports have opening sectional areas gradually reducing toward the area around the filter portion of the inner cylinder.

9. The engine lubricating device according to claim 2, wherein the filter portion of the inner cylinder is in a tapered shape having a diameter increasing from the closing plate at a lower end toward the upper end opening portion.

10. The engine lubricating device according to claim 3, wherein the filter portion of the inner cylinder is in a tapered shape having a diameter increasing from the closing plate at a lower end toward the upper end opening portion.

11. The engine lubricating device according to claim 4, wherein the filter portion of the inner cylinder is in a tapered shape having a diameter increasing from the closing plate at a lower end toward the upper end opening portion.

12. The engine lubricating device according to claim 7, wherein the filter portion of the inner cylinder is in a tapered shape having a diameter increasing from the closing plate at a lower end toward the upper end opening portion.

13. The engine lubricating device according to claim 8, wherein the filter portion of the inner cylinder is in a tapered shape having a diameter increasing from the closing plate at a lower end toward the upper end opening portion.

14. The engine lubricating device according to claim 2, wherein the closing plate and the shake preventing protrusions are integrally molded with the inner cylinder.

15. The engine lubricating device according to claim 3, wherein the closing plate and the shake preventing protrusions are integrally molded with the inner cylinder.

16. The engine lubricating device according to claim 4, wherein the closing plate and the shake preventing protrusions are integrally molded with the inner cylinder.

17. The engine lubricating device according to claim 7, wherein the closing plate and the shake preventing protrusions are integrally molded with the inner cylinder.

* * * * *